United States Patent [19]

West

[11] Patent Number: 4,769,972

[45] Date of Patent: Sep. 13, 1988

[54] FLEXIBLE BAG TAPING MACHINE

[75] Inventor: James G. West, Houston, Tex.

[73] Assignee: William E. Crawford, Houston, Tex.

[21] Appl. No.: 68,536

[22] Filed: Jul. 1, 1987

[51] Int. Cl.[4] ..... B65B 51/06

[52] U.S. Cl. ..... 53/415; 53/137; 53/210; 53/416

[58] Field of Search ..... 53/128, 137, 139.3, 53/415, 416, 419, 210, 220, 226, 233; 156/468, 475, 477.1, 483, 484, 485, 486, 521

[56] References Cited

U.S. PATENT DOCUMENTS

| | | | |
|---|---|---|---|
| 2,787,396 | 4/1957 | Christensson | 156/477.1 X |
| 3,110,143 | 11/1963 | Schooler | 53/220 |
| 3,229,594 | 1/1966 | Coussaye | 156/468 X |
| 3,269,078 | 8/1966 | Ouellette | 53/415 X |
| 3,577,866 | 5/1971 | Ehrenfried | 53/210 X |
| 4,033,089 | 7/1977 | Byland | 53/210 X |
| 4,227,955 | 10/1980 | Woods et al. | 156/468 X |
| 4,548,022 | 10/1985 | Yaklin | 53/415 |
| 4,592,189 | 6/1986 | Martini | 156/486 X |

*Primary Examiner*—James F. Coan
*Assistant Examiner*—Steven P. Weihrouch

[57] ABSTRACT

A machine for sealing the corner of a flexible bag member by applying a segment of adhesive tape from a roll of tape to a corner of the flexible bag where the tape is mechanically applied to the top, end and bottom surfaces of a corner of a bag member and a mechanical wiper applies an overhanging portion of the tape to a side surface in a neatly folded condition together with the mechanisms for supplying a cut segment of tape repetitively to bag members transported along a conveyor means.

14 Claims, 6 Drawing Sheets

FIG. 2
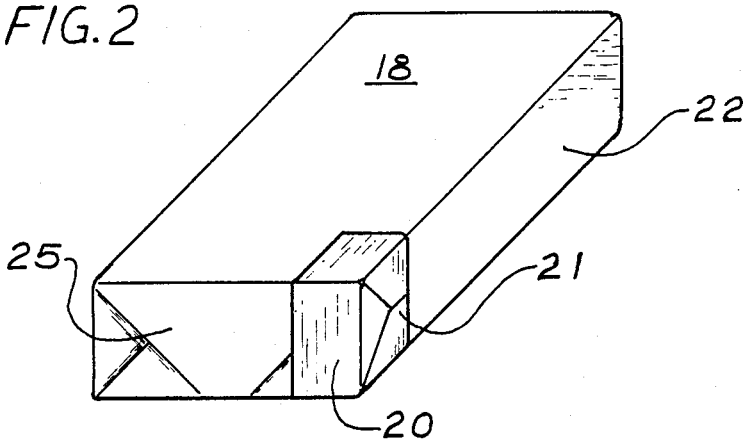
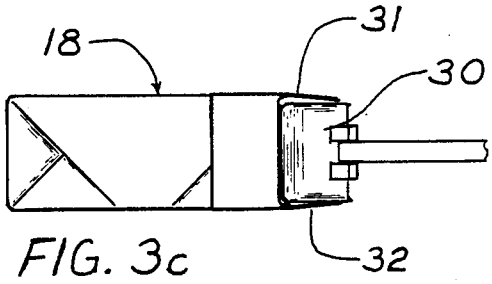
FIG. 3c
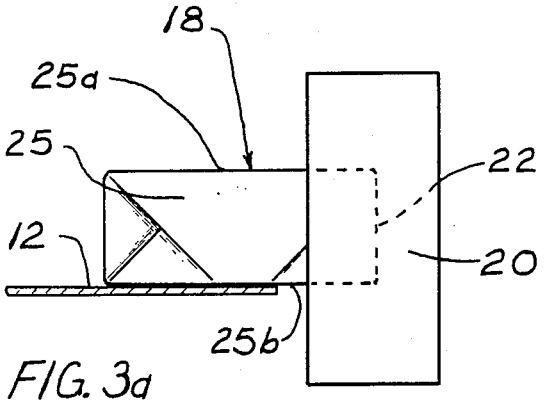
FIG. 3a
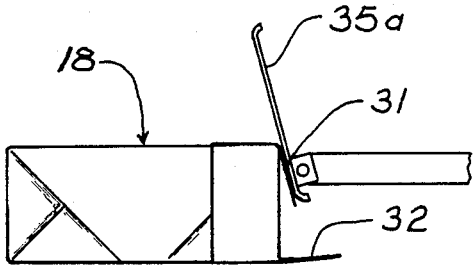
FIG. 3d
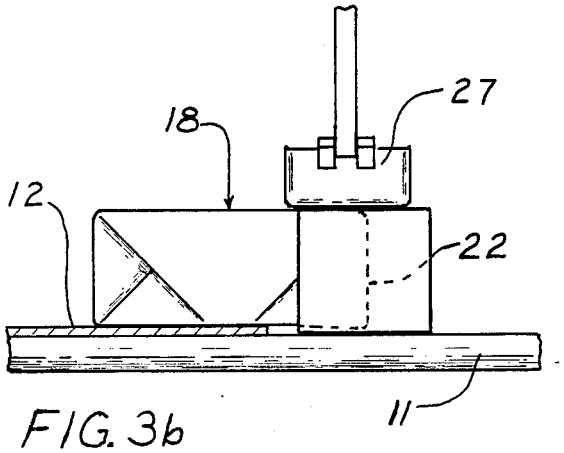
FIG. 3b
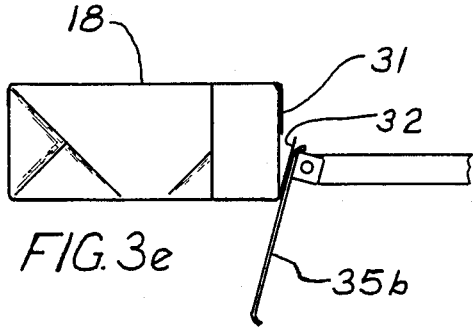
FIG. 3e

FLEXIBLE BAG TAPING MACHINE

FIELD OF THE INVENTION

This invention relates to flexible bag taping machines and more particularly, to taping machines for automatically supplying a segment of sealing tape and for automatically applying the sealing tape to the corner of a flexible bag member where the sealing tape is applied in a neatly folded condition.

BACKGROUND OF THE INVENTION

Heretofore, large flexible bags or bag members containing bulk chemicals have tended to leak materials after filling of the bags. Because of the leakage it has been necessary to tape filling corner of the bag by hand labor. The corner of the bag which is taped is the corner of the bag used for inserting the bulk chemicals into the bag member which is well known.

Heretofore, an apparatus and system has been provided for applying a tape seal to the corner of a bag member such machine being disclosed in U.S. Pat. No. 4,548,022 which issued on Oct. 22, 1985 to Leonard L. Yaklin. While the '022 patent discloses a satisfactory system for taping the corner of a flexible bag member it was determined that the taping mechanism for applying the adhesive tape could be improved by making the taping head simpler and less expensive as well as increasing the speed of the taping operation. In addition, it was found that the '022 patent did not produce an asthetically pleasing appearance for the sealing tape in that the side wipers more or less corrugated the tape appearance rather than providing a neatly folded tape appearance.

The present invention provides an improvement over the prior '022 system of sealing bags.

THE PRESENT INVENTION

The system of the present invention involves a belt conveyer for transporting flexible fill bag members through a tape sealing apparatus by means of a conveyer belt. A section of the bag member is arranged to overhang the edge of the conveyer belt. The tape head means, which has upper and lower tape heads, releasably positions a cut segment of adhesive tape with an adhesive portion in a facing position to the corner of an oncoming bag on a conveyer belt. The end of a bag member engages the central portion of the adhesive tape segment and wiper means above and below the bag members wipe the tape to the end, the top and the bottom surfaces of a bag member and a portion of the adhesive tape overhangs the edge of the bag member in a somewhat U-shaped fashion. As the bag progresses further along the conveyer belt means, a side paddle folds the central portion of the overhanging tape member inwardly and applies it to the side surface of the bag member while forming upper and lower ear portions on the overhanging tape portion. Subsequently, bias driven paddles alternately position the ear portions to the side surface of the bag so that the sealing of the tape member is in a neat orderly fashion on the corner of the bag member.

In the tape head apparatus, the upper and lower tape heads are provided with vertical openings defined between relatively movable gripping members so that the openings can be open or closed. In an open position of the gripping members a segment of adhesive tape can be passed through the upper member. Once primed, the head system operates automatically in a sequence which repetitively includes a step of placing the upper and lower heads in proximately to one another midway of a location which lies on a plane which would bisect a bag member in a lengthwise direction. The lower head assembly grasps an end of a tape member between the gripping members and thereafter the heads are moved apart in a vertical direction so that the lower head assembly pulls a tape section downwardly through the open gripping members and the upper tape head. When the upper and lower tape heads have reached a spaced apart position, a tape member extended between the tape heads will be at the proper distance above and below the top and bottom surfaces of bag member for sealing to the top and bottom surfaces of a bag member. When the tape heads reach their spaced apart position the upper tape head gripping member is closed on the tape and the tape is severed to provide a segment of tape extending between the upper and lower tape heads where the segment of tape is releasably held by the tape heads. In the taping operation as described above, the tape is released from the spaced apart heads. After the bag passes through the bag member, the head members are again brought to a proximate position to one another where the lower tape head again grips the tape member and the process of stretching a tape segment in front of a bag member is repeated.

The system is automatically controlled by switching and controls for sequential continuous operation of sealing the ends of bags and properly positioning tape for the sealing operation.

Referring now to the drawings in which an embodiment of the present invention illustrated:

FIG. 2 is a perspective view of a bag member with a sealed end as contemplated by the present invention;

Figure 4:
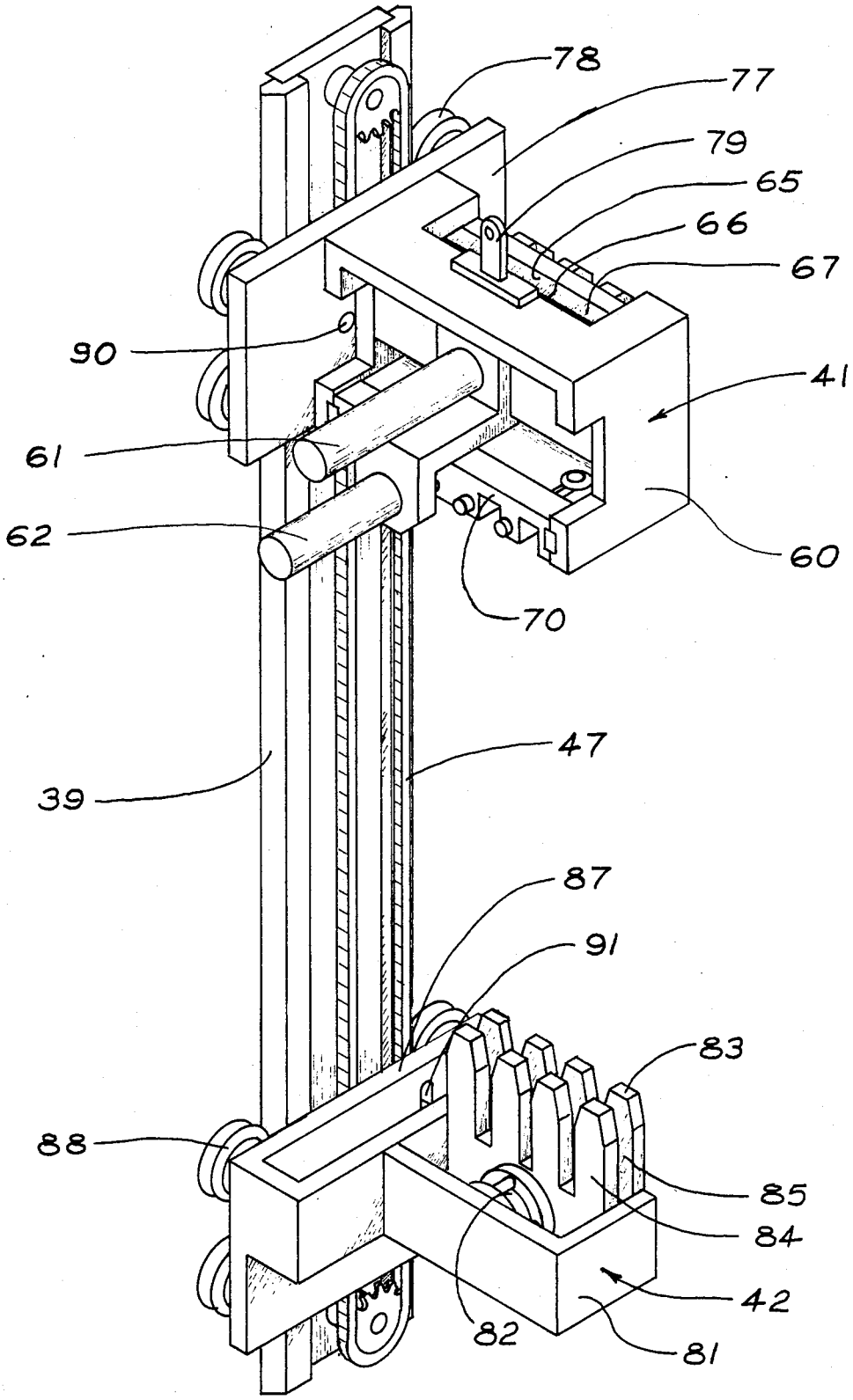
Figure 5C:
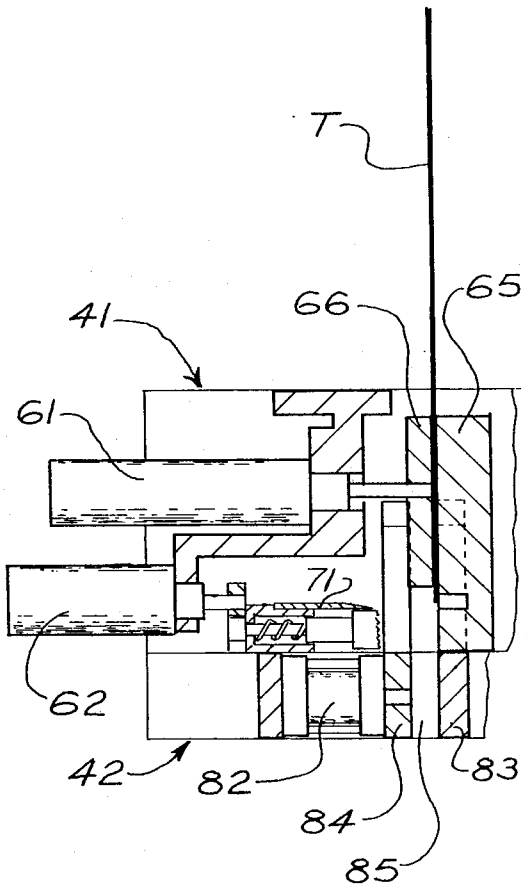
Figure 5B:
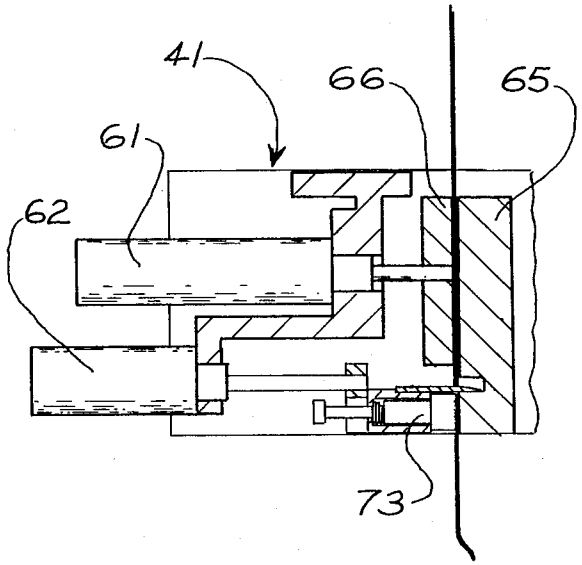
Figure 5B:
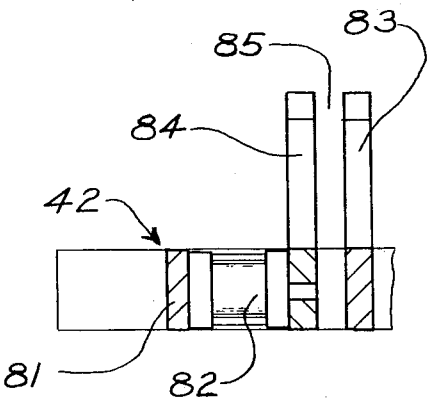
Figure 5A:
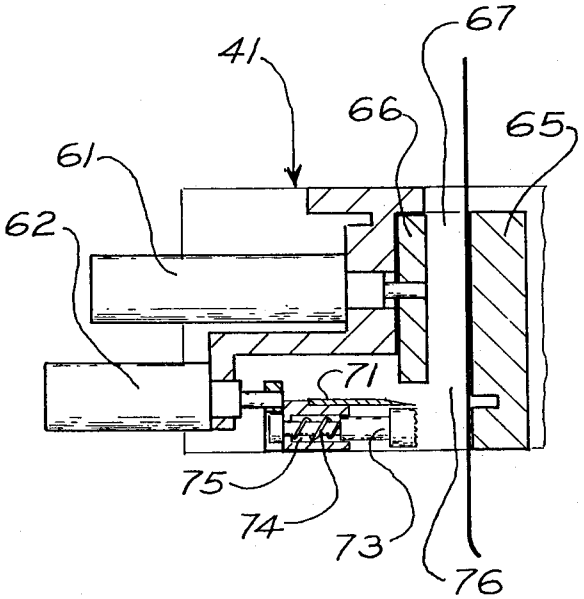
Figure 5A:
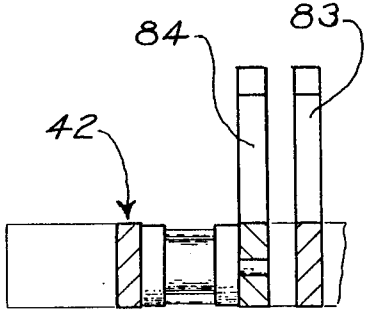
Figure 5F:
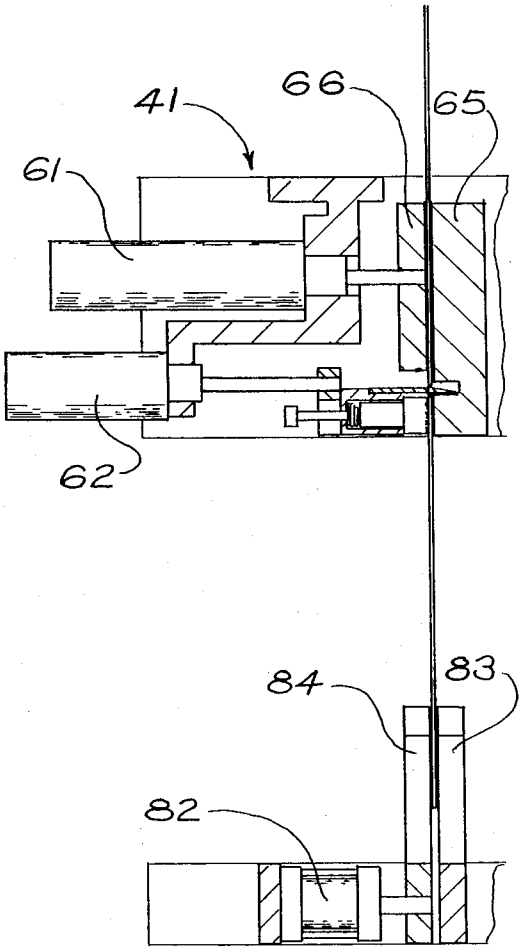
Figure 5E:
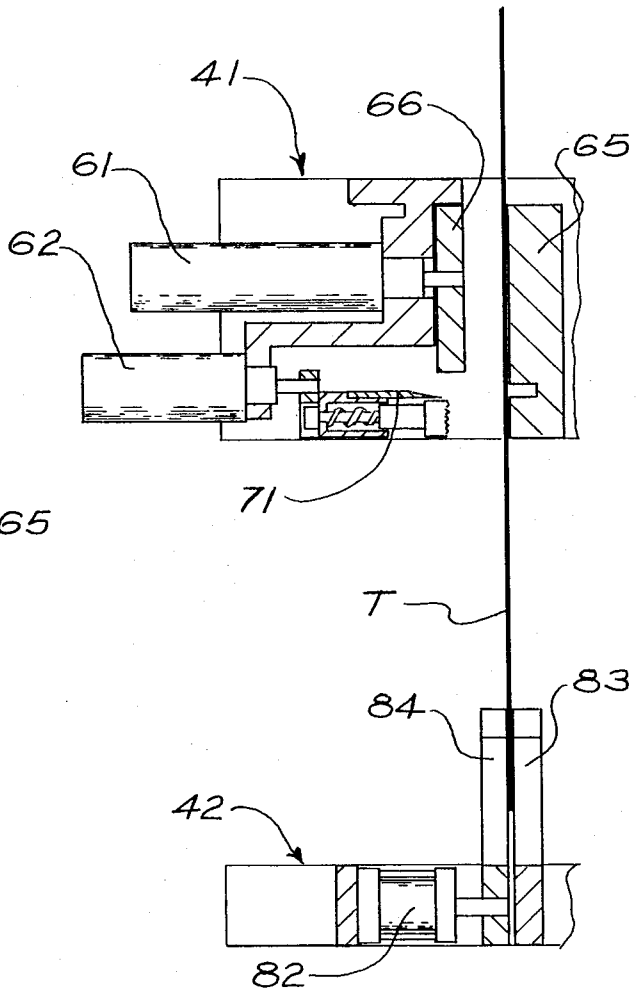
Figure 5D:
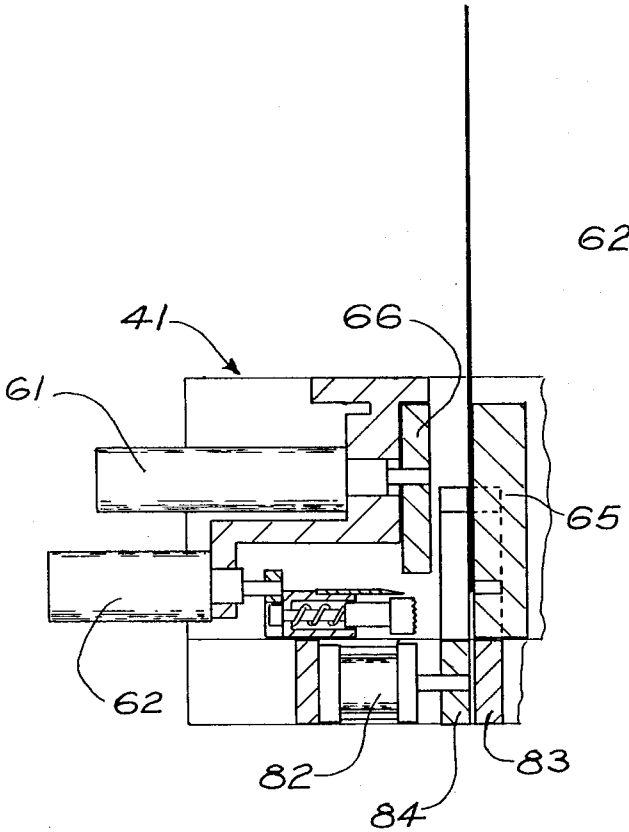
Figure 6:
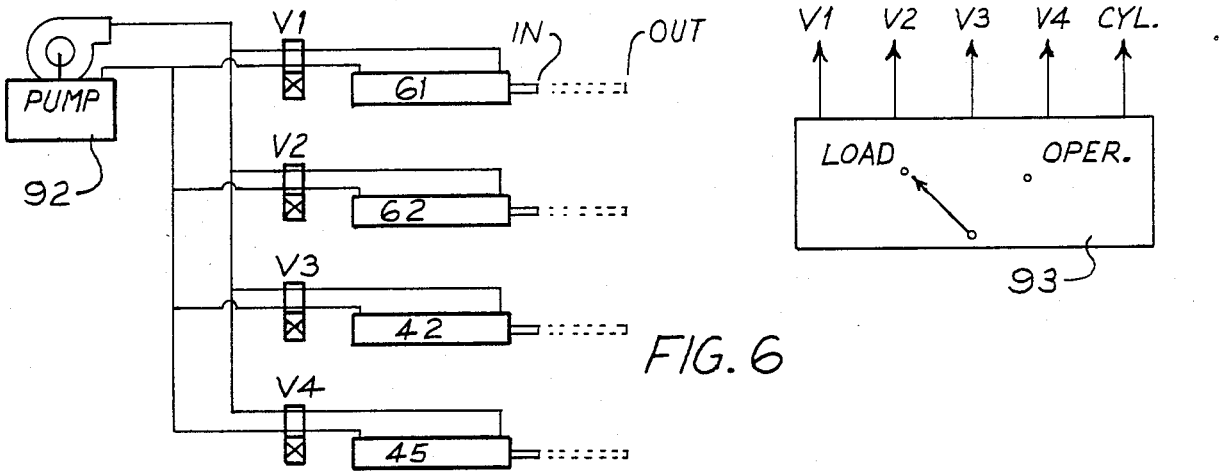
Figure 7A:
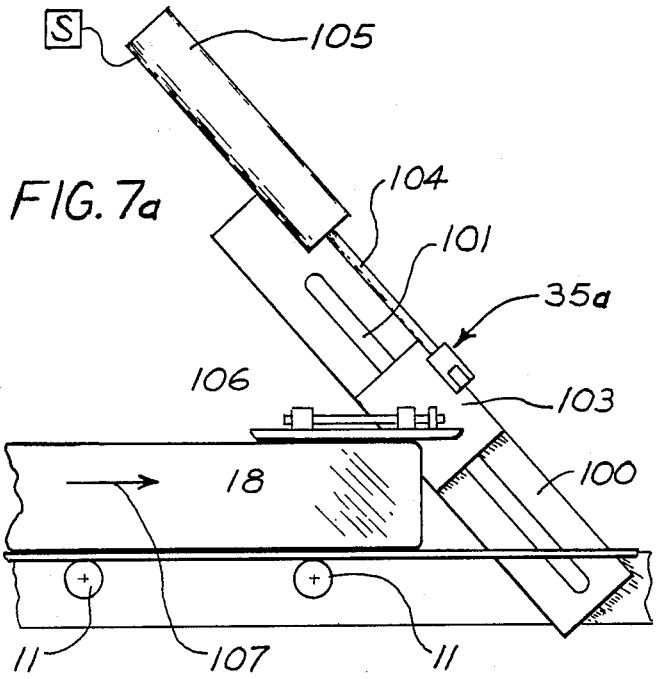
Figure 7B:
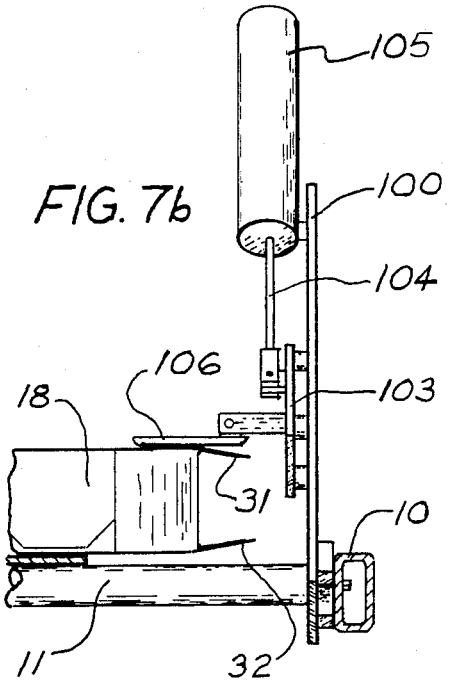

FIG. 3*a* is a frontal view of a bag member positioned for application of a sealing tape;

FIG. 3*b* is a frontal view of a bag member in position after the application of the top and bottom parts of the sealing tape;

FIG. 3*c* is a frontal view of a bag member in position after the side application of the sealing tape;

FIGS. 3*d* and 3*e* are frontal views of a bag member in position with the tape sections of a sealing tape being folded one upon the other;

FIG. 4 is a perspective view of the upper and lower tape head means;

FIG. 5*a* is a view in partial cross-section of the tape head means in an initial position;

FIG. 5*b* is a view in partial cross-section of tape head means in a spaced apart position for operation;

FIG. 5*c* is a view in partial cross-section of tape head means in an engaged position where the end of the tape is transferred from the grip of the upper head means to the lower head means:

FIG. 5*d* is a view in partial cross-section of tape head means in an engaged position after release of the tape by the upper head means;

FIG. 5*e* is a view in partial cross-section of tape head means in a spaced apart position where the tape is vertically disposed in the path of a bag member;

FIG. 5*f* is a view in partial cross-section of tape head means in position for operation of the application of a tape strip to a bag member;

FIG. 6 is a schematic illustration of a control system;

FIG. 7*a* is a side view of one side tape applicator;

FIG. 7*b* is a front view of the side tape applicator of FIG. 7*a;* and

Figure 7C:
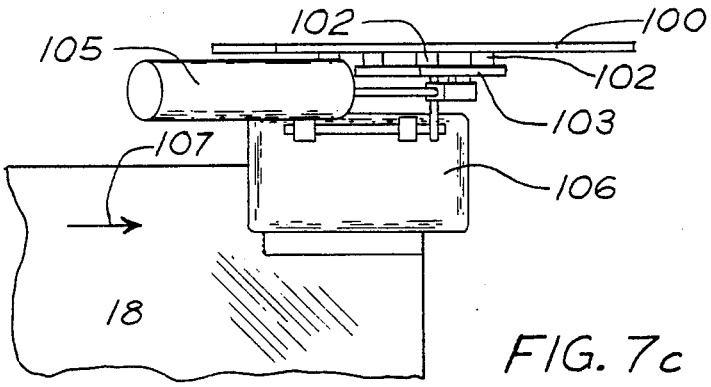

FIG. 7*c* is a top view of the side tape applicator of FIG. 7*a.*

DESCRIPTION OF THE INVENTION

Figure 1:
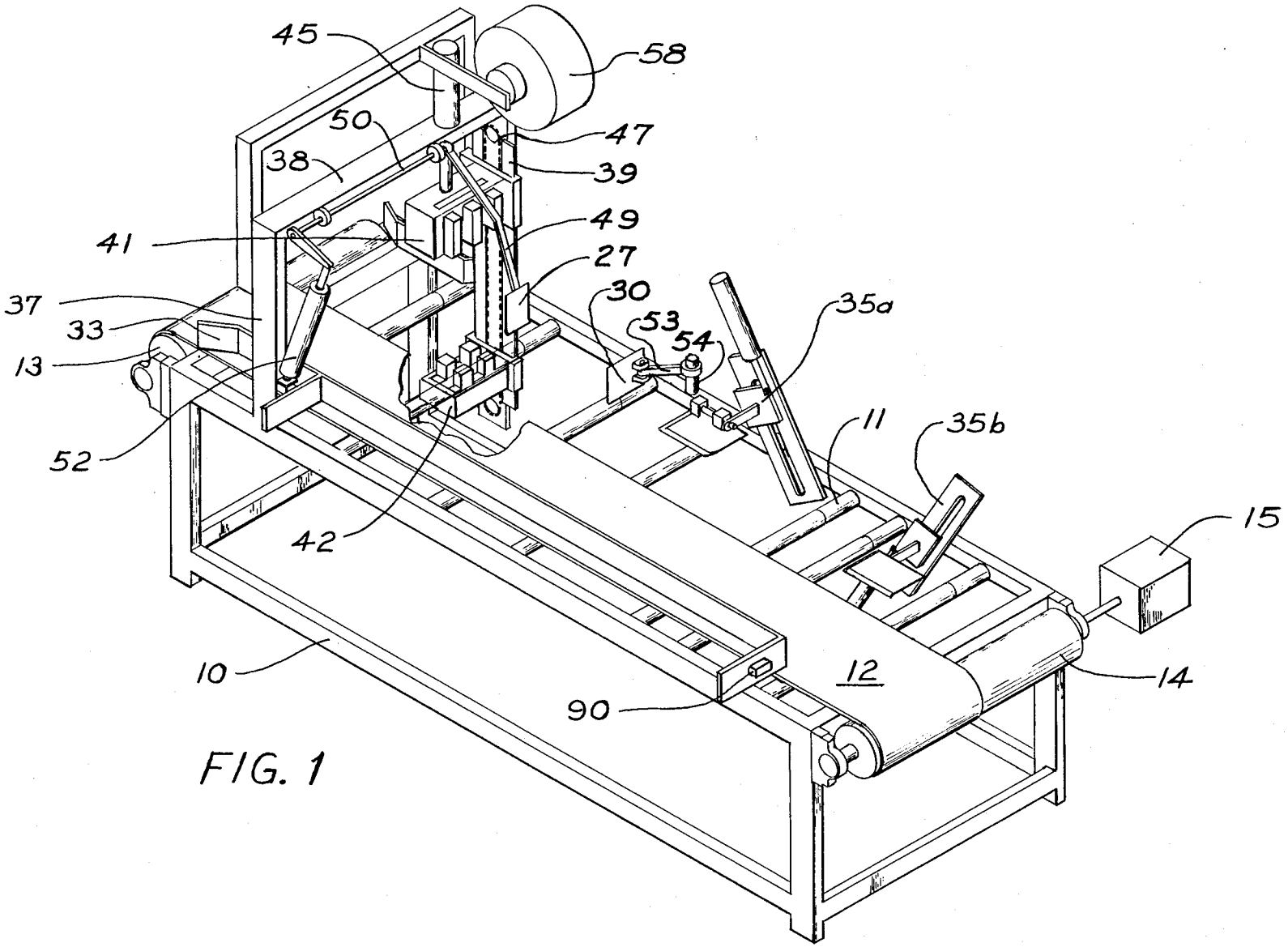
FIG. 1 illustrates a perspective overall illustration of an assembly embodying the present invention.

Referring now to FIG. 1, a supporting, rectangularly shaped frame structure 10 supports a number of rotatable support rollers 11 where the rollers or roller members 11 define a movable table means for transporting elongated bag members along a defined pathway. An endless conveyer belt means 12 extends the entire upper length of the frame structure 10 and is supported at one end by a forward conveyer roller 13 and at the other end by a rearward conveyer roller 14. Intermediate of the length of the conveyer belt 12 the supporting rollers 11 are arranged so that the conveyer belt means 12 can support and transport bag members. The conveyer rollers are suitably mounted in the frame structure 10 for rotation. The rearward conveyer roller 14 is driven by a drive motor 15 to transport a bag member on the belt means.

As shown in FIG. 2, a bag member 18 is a rectangularly shaped elongated member typically constructed of heavy paper material. A preformed bag member 18 is typically filled with a product in pellet or granular form, for example, through an opening in a fold at one of its bottom end corners. This opening if not properly sealed subsequent to filling the bag member can leak materials. In the present invention a tape material or member 20 is applied to the corner of the bag member having the fill opening so as to seal the top, end and bottom surfaces about the fill opening and fold the tape material into a neat appearing seal 21 on a side edge surface 22 of the bag member 18.

The apparatus initially holds the sealing tape member 20, as shown in FIG. 3*a*, in a vertical and perpendicular relationship to an end surface 25 of the bag member 18. The tape member 20 has upper and lower portions which respectively extend above and below the edges 25*a*, 25*b* of the end surface 25. The tape member 20 also extends outwardly to one side of the edge surface 22. In the first step of the process, the tape member 20 is applied with its adhesive side into contact with the end surface 25 as shown in FIG. 3*a*.

As the tape member 20 and bag member 18 progress further through the apparatus, in the next step, an upper paddle means 27 located above the bag member 18 engages the end surface 25 and the tape member and the paddle means 27 wipes and applies the tape member 20 to the top or upper surface of a bag member 18 while the bag member is moving. Contemporaneously therewith, a roller member 11 below the bag member 18 wipes and applies the tape member 20 to the bottom or lower surface of the bag member 18. Thus the tape member 20 is now adhesively attached to the top, end, and bottom surfaces of a bag member with a U-shaped portion of the tape member overhanging the side surface 22 of the bag member.

As the bag member 18 progresses further through the apparatus, in the next step, a side paddle means 30 engages the end surface 25 of the bag member to wipe and apply the central portion of the overhanging tape member to the side edge surface 22. In so doing, the tape member forms upper and lower ear portions 31, 32 which in part have exposed adhesive portions. The vertical width of the paddle means 30 is less than the width of a bag member so that the ear portions 31, 32 are formed to fold inwardly toward one another.

As shown in FIGS. 3*d* and 3*e*, upper and lower side tape applicators 35*a* 35*b* are arranged to sequentially engage the outer surfaces of the upper and lower ear portions 31, 32 and fold them smoothly one upon the other on the side edge surface 22 of the bag member 18 to complete the sealing enclosure of a corner of a bag member 18.

Returning again to FIG. 1, a bag member 18 to be sealed is initially loaded into the belt means 12 at the forward end of the frame structure. Side guides 33 and 34 are provided for aligning a bag member with respect to the belt means 12 so that the corner of the bag member to be sealed is over an open portion or section of the rollers 11.

A rectangularly shaped vertical frame support means 37 is disposed on the frame structure 10 near the forward end of the conveyer belt 12 and includes a transverse frame portion 38 located above the conveyer belt 12. On the side of the frame support 37 adjacent to the open section of the rollers 11 are vertical guide means 39 for slidable mounting of upper and lower tape head means 41, 42. The upper tape head means 41 is attached to a piston rod 44 of a hydraulic cylinder mechanism 45 for actuating both of the tape head means. Operation of the cylinder mechanism 45 shifts the upper tape head means 41 in a vertical direction between upper and lower positions. The lower tape head means 42 is disposed below the surface of the conveyer belt 12 and is slidably mounted on the guide means 39. The upper tape head means 41 and the lower tape head means 42 are respectively coupled to an endless chain 47 so that the upper tape head means 41 and the lower head means 42 can be moved toward and away from one another by movement of the connecting chain 47. The chain is mounted on upper and lower gear or chain sprockets on the guide means 39.

The upper paddle means 27 is pivotally attached to a bar member 49 which, in turn, is attached to a shaft 50. The shaft 50 is rotatably mounted with respect to the frame means 37 and is rotatable by an arm and piston member in a hydraulic cylinder means 52. A side paddle means 30 is pivotally connected to a connecting rod member 53 and rotatably connected to a vertical shaft 54 on the frame structure.

Near the exit end of the belt means 12 are arm upper side tape applicator means 35*a* and a lower side tape applicator means 35*a* which are attached to the support frame and are adapted to perform the sealing functions of folding the flaps of a tape member upon one another and onto the side of a bag member.

In the frame structure, above the upper tape head means 41, a roll of one-sided adhesive tape 58 is mounted with respect to the frame and the upper tape head means 41 so that a strip of adhesive tape can be passed through the upper tape head means 41 and releasably connected to the lower tape head means 42. In this invention, the upper and lower tape heads 41, 42 function to hold a discrete section of one-sided adhesive tape with an adhesive portion in a facing position toward one corner of an oncoming or moving bag member where the end portions of the facing tape section are disposed above and below the top and bottom surfaces of the bag member and where a part of the width of the facing tape section is disposed to overlap or extend outwardly of a side surface of the bag member. As the bag member engages the facing end of a bag member, the tape sticks to the end surface of a bag member and the sections of tape above and below the bag member are held by the tape heads. Progression of the bag member between the spaced apart tape heads adheres a part of the mid-portion of the tape member to the corner of the bag member while part of the mid-portion of the tape member overhangs the end of the bag member. The upper wiping paddle means 27 extends downwardly with a portion thereof arranged to engage the end surface of a bag member and thereafter wipe the tape member into adherence with the upper surface of a bag member. The lower depending tape member is wiped between the surface of a roller member 11 which wipes the tape member into adherence with the lower surface of the bag member.

As the bag member progresses further, the side paddle means 30 engages the mid-section of the overhanging portion of the tape member and wipes the mid-section of the tape member into the side or edge surface of a bag member. This step leaves upper and lower flaps or ear portions in which an adhesive portion remains exposed. Progressing further, the bag member actuates an upper tape actuator means 35*a* which folds the upper ear portion 31 on the side surface of the bag member while the bag member is moving and the bag member actuates a lower tape actuator means 35*b* which folds the lower ear portion 32 on the side surface of the bag member.

Referring to FIG. 4, the upper and lower tape head means 41, 42 are illustrated on the guide means 39. The upper tape head assembly or means 41 includes a box like, rectangularly shaped frame member 60 which supports an attached jaw cylinder means 61 and an attached cutter cylinder means 62. Each of the cylinder means 61, 62 has a piston in a cylinder which is actuated by hydraulic pressure to move a piston rod.

The frame member 60 includes a vertical fixed, gripper face member 65 which is generally rectangular in shape. The piston rod of the jaw cylinder means 61 is attached to a rectangularly shaped, vertically arranged movable gripper face member 66. The movable face member is in a facing relationship to the vertical, fixed gripper face member 65. The face members 65, 66 in FIG. 4 are shown in an open position with a space 67 therebetween. Thus a sealing tape member can be passed between the face members 65, 66 in an open position of the face members. While not illustrated in detail, the face members 65, 66 at the bottom surfaces are arranged to form fingers which can intermesh with fingers on a bottom tape head means 42 as will hereinafter be explained.

Below the bottom edge surface of the movable gripper face member 66 is a cutter base member 70 which is attached to the piston rod of the cutter cylinder means 62. On the upper surface of the cutter base member 70 is a cutter blade 71 which extends over the width of the cutter base member 70. Below the cutter blade 71 are a number of cylindrically shaped plunger members 73 (see FIG. 5*a*) which are located in blind bores 74 in the base member and are normally biased by spring means 75 to an extended position. In facing relationship to the cutter blade 71 is a lengthwise extending groove 76 in the fixed gripper face member 65, the groove 76 being sized to receive the cutting edge of the cutter blade.

As shown in FIG. 5*a*, when the piston rods are contracted within the cylinders 61, 62 the face members 65, 66 are spaced apart from one another and the edge of the cutter 71 is spaced away from the groove 76 in the face member 65. Thus, a flat strip of sealing tape can be inserted through the opening or space 67 between the gripper face members.

The frame member 60 is attached to a vertical plate 77 which has attached guide rollers 78. The guide rollers engage the edges of the guide means 39. A tongue 79 is used to attach the head assembly to a piston rod of the cylinder means 45.

The lower tape head assembly 42 includes a box like frame member 81 which carries an attached lower gripper cylinder means 82. The frame member 81 has a vertical, rectangularly shaped fixed gripper face plate member 83. The piston rod of the cylinder means 82 is attached to a movable gripper face plate member 84 which is in a facing and spaced apart relationship to the fixed gripper face plate member 83. In the position shown, a flat strip of tape can be passed in the opening 85 between the gripper face plate members 83, 84. As shown, the plate members 83, 84 form upwardly extending finger members which intermesh with finger members on the upper tape head member 41.

The frame member 81 is attached to a vertical plate 87 which has attached guide rollers 88. The guide rollers engage the edges of the guide means 37.

The upper tape head assembly 41 is attached by an attachment 90 to one side of the endless chain 47 while the lower tape head assembly is attached by an attachment 91 to the other side of the chain 47.

Referring now to FIG. 5*b*, after a strip of tape is disposed between the upper gripper face plate members 65, 66, the upper cylinder means 61, 62 are actuated to move both the gripper face member 66 and the cutter blade 71 and finger members 73 into the relationship shown in FIG. 5*b* where the strip of tape is gripped in the upper tape head assembly 41. Upon gripping the strip of tape, the upper and lower tape head assemblies are moved toward one another (by cylinder means 45 and chain 47) until the upper and lower frame means 41, 42 engage with one another. Movement is obtained by actuating the cylinder means 45 and the interconnection with the chain means 47.

As shown in FIG. 5*c*, the cutter cylinder means 62 is actuated to retract the cutter blade 71 to its retracted position so that in the engagement position of the tape head means 41, 42, the strip of tape gripped between the gripper members 65, 66 of the upper tape head means 41 is disposed between the open gripper face plate members 83, 84 of the lower tape head assembly 42. Next, the lower cylinder means 82 is actuated to close the lower gripper plate members 83, 84 on the tape followed by actuation of the upper cylinder means 61 to move the gripper plate members 65, 66 to a retracted position. (See FIG. 5*d*). Thus, the strip of tape is released relative to the upper tape head means 41 and is grasped by the plate members 83, 84 of the lower tape head means 42.

Next, the upper and lower tape head assemblies 41, 42 are simultaneously moved apart from one another so that the strip of tape T is pulled downwardly by the lower tape head assembly 42 and is extended between the upper and lower tape head assemblies 41, 42. (See FIG. 5*e*). At the extended positions of the tape head assemblies 41, 42, the cylinder means 61, 62 are actuated to move the extended gripper members 65, 66 and the cutter blade 71 to a closed position (See FIG. 5*b* also) so that the strip of tape T extended between the tape heads means 41, 42 is severed by the cutter 71 and can be applied to a bag member.

Referring now to FIGS. 7(*a*)-7(*c*), the upper tape applicator means 35(*a*) is illustrated, the lower tape applicator means 35*b* being constructed and located on the frame for a similar type of function.

A tape applicator means 35*a* includes an elongated support or guide member 100 which is attached to the frame 10 at an angle with respect to the horizontal. The guide member 100 has an elongated slot 101 which slidably receives guide pins 102. The guide pins 102 slidably mount a carriage plate 103. The carriage plate 103 is "L" shaped and attached to a piston rod 104 in a hydraulic cylinder 105 where the cylinder 105 is attached to the guide 100. Actuation of the cylinder 105 moves the carriage plate 103 from a position above a bag member to a position in the frame member 10 below the rollers 11 and below a bag member. On the "L" shaped carriage plate 103 is a pivotally mounted paddle 106. The paddle 106 is pivotally mounted about a pivot axis parallel to the direction 107 of bag travel on the conveyer belt. The paddle 106 has a flat surface which is arranged generally parallel to the top and bottom surfaces of a bag member. The pivot axis for the paddle is arranged to be to one side of a side surface of a bag member so that the paddle 106 is parallel to the top surface of a bag member and will first engage a top surface of a bag member and then will pivot 90° about the pivot axis in applying an ear position 31 to the side surface of a bag member. The angle of the diagonal mounting of the carriage 103 is coordinated with the speed of the belt and the operation of the cylinder 105 so that the speed of a paddle in a horizontal direction matches the speed of the bag member 118. The result is a perpendicular motion of the paddle relative to the bag member causing the ear portion 31 to be affixed to the bag member.

Each of the tape actuator means 35*a*, 35*b* functions in response to a sensor S which is located along the frame 10 to detect the presence of a bag member and drive the upper paddle down and the lower paddle up as the bag member passes by thereby applying the ear portions to the side of a bag member. The sensor members operate to cause reciprocation of the carriage 103 between upper and lower positions in synchronism with the travel and pressure of a bag member 18.

OPERATION

Initially, the tape head means 41, 42 are spaced apart from one another. The gripper plates 65, 66 and 83, 84 are open or separated from one another and a loose end of strip of tape extends through upper tape head means 41.

Load tape step

1. The cylinders 61, 62 are actuated so that the movable gripper plate 66 on the upper tape head 41 engages the fixed gripper plate 65 and the cutter blade 71 severs the depending end of the strip of tape T. The cutter blade 71 is retracted.

2. The upper tape head means 41 is driven by the actuation of the cylinder means 45 to move downwards to a point just above the drive belt 12 while the lower tape head means 42 is raised to engage the upper tape head means 41. Gripping teeth in the upper and lower tape head means mesh with one another while the strip of tape is held by the upper head means.

3. In the meshed position of the tape head means, the upper tape head means holds a portion of the tape between the fixed and movable plates of the lower tape head means 42.

4. Next, the cylinder means 82 is actuated to that the movable plate means 84 of the lower tape head means 42 moves to engage the strip of tape.

5. The cylinder means 61 is deactivated so that the movable plate 66 of the upper tape head means 41 releases the strip of tape T.

6. The cylinder means 45 moves the upper head means 41 upwardly and the lower head means 42 downwardly. As the lower tape head means 42 is moved below the drive belt 12, the strip of tape is pulled downwardly with it.

7. At the fully spaced apart position of the tape head means 41, 42, the upper tape head cylinders 61, 62 are actuated to move the blade 71 and the tape and holding the tape in place between the plate members 65, 66. The upper end of the cut tape is stretched taut between the upper and lower tape heads and is held by the gripping fingers 73.

In operation after a strip of tape is loaded in place, a bag member is placed on the belt 12.

The alignment of the bag member is such that one half of the strip of tape is pressed against the end of the bag member and one half of the strip of tape overlaps the side edge of the bag member. Before the bag member reaches the strip of tape between the tape heads 41, 42, a sensor detects the presence of the bag member and releases both gripping plate members.

As the bag is moved into contact with the strip of tape, the paddle 27 provides some of the initial contact force on the end of the bag to make the tape stick. The actuation of its cylinder 52 is to bring it into contact with the tape before the bag hits, or to move it out from between the heads to allow them to mesh. Paddle 27 also presses the top portion as described. As the bag member progresses, the lower rollers 11 press the strip of tape to the underside of the bag member while the vertically mounted wiper paddle 27 presses the sealing tape against the top of the bag. The paddle 27 is maintained at a desired pressure force by a cylinder means 52. Movement of the paddle 27 actuates the cylinder 82 so that the plates 83, 84 are separated and release the tape.

The tape is applied as described with respect to FIGS. 3(*a*)-3(*e*). A sensor 90 activates the tape head means 41, 42 to reposition a vertical strip of tape in the path for a bag member.

Referring to FIG. 6, the cylinder means have hydraulic pressure lines respectively coupled to electrically controlled reversing valves V1–V4 and to a pump system 92. By control of the valves, the cylinder means can move their piston rods to "in" and "out" positions. An electrical control means 93 provides electrical control and programing of the sequence of operations. In the schedule below the position of the cylinder rods and tape positions is detailed for further understanding of the sequence of operations.

TABLE I

| | | | | | | | | |
|---|---|---|---|---|---|---|---|---|
| cyl 61 | in | out | out | out | in | in | out | out |
| cyl 62 | in | out | in | in | in | in | out | out |
| cyl 42 | in | in | in | in | out | out | out | in |
| cyl 45 | in | in | in | out | out | in | in | in |
| tape position | A | B | C | D | E | F | G | H |

A tape loose between plates 65, 66; paddle 27 down between heads 41, 42
B tape gripped by plates 65, 66, cut by cutter 71

TABLE I-continued

| |
|---|
| C cutter moved out of way; paddle 27 rotated away |
| D tape pulled between lower heads, head pulled together |
| E tape gripped by lower head plates |
| released from upper tape head plates |
| F tape heads separated to pull strip of tape into path |
| of bag member; paddle 27 rotated down against tape |
| G strip of tape held between buttons 73 in upper tape head |
| 41 and lower tape head means, tape is cut by blade 7 |
| and held by plates 65, 66 |
| H after the forward end of the bag member passes the |
| lower tape head means, the plates 83 84 are separated |

In sealing the ear portions 31, 32, the sensor S operates a cylinder 105 to reciprocate a paddle 106 to sequentially apply the ear portions 31, 32.

It will be apparent to those skilled in the art that various changes may be made in the invention without departing from the spirit and scope thereof and therefore the invention is not limited by that which is enclosed in the drawings and specifications but only as indicated in the appended claims.

I claim:

1. A method for applying an adhesive sealing tape to the corner of a flexible package member from a roll of adhesive sealing tape including the steps of:

disposing a finite strip of adhesive tape vertically relative to a horizontally traveling flexible package member on a conveyer belt so that the strip of tape will have tape portions above and below the top and bottom surfaces of the package member as well as tape portions extending outwardly away from the vertical side surface of the package member, moving the package member by the conveyer belt into the strip of tape and applying sealing pressure to the tape portions on the top and bottom surfaces of the package member, moving the package member and the tape portions applied to the top and bottom surfaces of the bag member by the conveyer belt while applying a sealing pressure to the tape portion extending outwardly away from the vertical side surface and to the vertical side surface of the package member where said sealing pressure is applied over an interval less than the width of the side surface so as to form upper and lower ear portions on the tape portions extending outwardly away from the vertical side surface, and moving the package member by the conveyer belt while applying a sealing pressure to the upper and lower ear portions of the tape portions to fold the ear portions one upon the other.

2. A method for disposing tape vertically with respect to a conveyer means which moves in a transverse direction to the tape comprising the steps of:

moving the end of a length of sealing tape vertically downward with an upper gripper head from a position above a conveyer means to a lower gripper head, grasping the end of the length of sealing tape with the lower gripper head, releasing the sealing tape relative to the upper head and moving the upper and lower gripper heads to locations above and below the conveyer means, grasping the tape in the upper gripper head while severing the tape into a discrete strip so that said discrete strip of tape may be applied to the corner of a package member on the conveyer means.

3. The method as set forth in claim 2 and further including the step of moving a package member by the conveyer means so that a corner of the package member is disposed midway of the width of the sealing tape, applying sealing pressure to the tape portions and package member to affix the tape to the top, end and bottom surfaces of the package member with a portion of tape extending outwardly of the package member, applying sealing pressure to the mid-portion of the tape extending outwardly of the bag member to affix the tape to a side surface of the package member while forming ear portions on the tape, and folding the ear portions of the tape one upon the other on the side surface of a package member.

4. Apparatus for applying sealing tape to a corner of an elongated container comprising:

conveyer means for conveying containers through said apparatus, taping means disposed along said conveyer means for selectively supplying discrete strips of tape from a roll of adhesive sealing tape where such discrete strips of tape are positioned transverse to the direction of travel of said conveyer means, said taping means including upper and lower head assemblies which are movable between a spaced apart position above and below the conveyer means to a contact position, means for mounting said upper and lower head assemblies and for moving said head assemblies between said spaced apart position and said contact position, each of said head assemblies having plate means for releasably gripping a sealing tape so that said upper head assembly may transport an end of the sealing tape to said lower head assembly while moving from said spaced apart position to said contact position and so that when said assemblies are in said spaced apart position said plate means can releasably grip a discrete strip of sealing tape therebetween, and means in said upper head assembly for separating said sealing tape from the roll of the tape for forming a discrete strip of tape between said head assemblies so that such discrete strip of tape may be applied to a corner of a container on said conveyer means.

5. The apparatus as set forth in claim 4 wherein said plate means includes a fixed plate member and a movable plate member and wherein said plate members are arranged with finger portions which permit the finger portions of an upper head assembly to intermesh in a side by side relationship with the finger portions of a lower head assembly.

6. The apparatus of claim 5 wherein said upper head assembly includes spring biased gripper means for releasably engaging a strip of tape.

7. Apparatus for applying sealing tape to a corner of an elongated container comprising:

conveyer means for conveying containers through said apparatus, taping means disposed along and to one side of said conveyer means for selectively supplying discrete strips of tape from a roll of adhesive sealing tape where such discrete strips of tape are positioned transverse to the direction of travel of said conveyer means, said taping means including upper and lower head assemblies, movable between a spaced apart position above and below the conveyer means and a contact position, means for mounting said upper and lower head assemblies and for moving said head assemblies between said spaced apart position and said contact position, each of said head assemblies having plate means for releasably gripping a strip of sealing tape so that said upper head assembly may transport an end of the sealing tape to said lower head assembly while moving from said spaced apart position to said contact position and so that said head assemblies in said spaced apart position and releasably grip a discrete strip of sealing tape therebetween, means for selectively actuating said plate means for movement between gripping and non-gripping conditions, and means for selectively separating said strip of sealing tape into a discrete strip of tape between said head assemblies so that such discrete strip of tape may be applied to a corner of a container on said conveyer means.

8. The apparatus as set forth in claim 7 wherein said means for mounting includes a frame member for slidably supporting said head assemblies and means for interconnecting said head assemblies whereby movement of one head assembly produces a corresponding movement in the other head assembly.

9. The apparatus as set forth in claim 7 wherein said upper head assembly has downwardly facing spaced apart finger members and wherein said lower head assembly has upwardly facing spaced apart finger members, said finger members of said upper and lower head assemblies being interfitting in common planes so that while said finger members are interfitting, the plate means may be moved transversely to the common planes for transferring a grip on a sealing tape.

10. Apparatus for applying adhesive sealing tape in a folded condition to the corner of a flexible bag member comprising:

conveyor means for conveying bag members along a conveyor plane through said apparatus, taping means for applying a strip of adhesive sealing tape to the top, bottom and end of a bag member with a U-shaped section of sealing tape overhanging a side surface of a bag member, side paddle means for engaging said U-shaped section of sealing tape and for applying pressure to the mid-portion of said U-shaped section to apply said mid-portion to said side surface while forming upper and lower tape ear portions, first tape applicator means having a first tape ear paddle member pivotally mounted for rotation about a pivot axis disposed parallel to said conveyor plane and the direction of travel for said conveyor means, said pivot axis also being located to one side of said conveyor means so as initially to be located above and to one side of a side surface of a bag member disposed on said conveyor means, and means for moving said pivot axis of said first tape ear paddle member from an initial position located above a top surface of a bag member to a position located between the top and bottom surfaces of a bag member for applying pressure to adhere a tape ear portion to the side of a bag member.

11. The apparatus as set forth in claim 10 and further including:

second tape applicator means having a second tape ear paddle member pivotally mounted for rotation about a pivot axis disposed parallel to said conveyor plane and the direction of travel for said conveyor means, said pivot axis also being located to one side of said conveyor means so as initially to be located below and to one side of a side surface of a bag member disposed on said conveyor means, and means for moving said pivot axis of said second tape ear paddle member from an initial position located below a bottom surface of a bag member to a position located between the top and bottom surfaces of a bag member for applying pressure to adhere a tape ear portion to the side of a bag member.

12. The apparatus as set forth in claim 16 and further including:

taping means disposed along said conveyer means for selectively supplying discrete strips of tape from a roll of adhesive sealing tape where such discrete strips of tape are positioned transverse to the direction of travel of said conveyer means, said taping means including upper and lower head assemblies which are movable between a spaced apart position above and below the conveyer means to a contact position, means for mounting said upper and lower head assemblies and for moving said head assemblies between said spaced apart position and said contact position, each of said head assemblies having plate means for releasably gripping a sealing tape so that said upper head assembly may transport an end of the sealing tape to said lower head assembly while moving from said spaced apart position to said contact position and so that when said assemblies are in said spaced apart position said plate means can releasably grip a discrete strip of sealing tape therebetween, and means in said upper head assembly for separating said sealing tape from the roll of the tape for forming a discrete strip of tape between said head assemblies so that such discrete strip of tape may be applied to a corner of a container on said conveyer means.

13. The apparatus as set forth in claim 12 wherein said plate means includes a fixed plate member and a movable plate member and wherein said plate members are arranged with finger portions which permit the finger portion of an upper head assembly to intermesh in a side by side relationship with the finger portions of a lower head assembly.

14. The apparatus of claim 13 wherein said upper head assembly includes spring biased gripper means for releasably engaging a strip to tape.

* * * * *